US009566637B2

(12) United States Patent
Kalkau

(10) Patent No.: US 9,566,637 B2
(45) Date of Patent: Feb. 14, 2017

(54) METHOD AND APPARATUS FOR PRODUCTION OF HELICAL SPRINGS BY SPRING WINDING

(75) Inventor: Volker Kalkau, Lichtenstein (DE)

(73) Assignee: WAFIOS AG (DE)

( * ) Notice: Subject to any disclaimer, the term of this patent is extended or adjusted under 35 U.S.C. 154(b) by 0 days.

(21) Appl. No.: 12/900,793

(22) Filed: Oct. 8, 2010

(65) Prior Publication Data

US 2011/0239718 A1 Oct. 6, 2011

(30) Foreign Application Priority Data

Apr. 6, 2010 (DE) ..... 10 2010 014 385

(51) Int. Cl.
*B21F 3/02* (2006.01)
*B21C 51/00* (2006.01)
*B21F 35/00* (2006.01)

(52) U.S. Cl.
CPC ..... *B21F 3/02* (2013.01); *B21C 51/00* (2013.01); *B21F 35/00* (2013.01)

(58) Field of Classification Search
CPC ..... B21D 5/04; B21D 3/10; B21D 3/16; B21D 7/025; B21F 3/02; B21F 3/04; B21F 35/00; H01R 43/033; B21C 51/00
(Continued)

(56) References Cited

U.S. PATENT DOCUMENTS 5,243,746 A 9/1993 Shinichi
5,363,681 A 11/1994 Speck et al.
(Continued)

FOREIGN PATENT DOCUMENTS

DE 42 29 294 C1 12/1993
DE 103 45 445 A1 9/2004
(Continued)

OTHER PUBLICATIONS

Comments in English of Japanese Associates regarding the Japanese Official Action dated Apr. 8, 2014 from corresponding Japanese Patent Application No. 2011-058680 (1 sheet).
(Continued)

*Primary Examiner* — David Bryant
*Assistant Examiner* — Lawrence Averick
(74) *Attorney, Agent, or Firm* — DLA Piper LLP (US)

(57) ABSTRACT

A method of producing helical springs by spring winding with a numerically controlled spring winding machine includes feeding a wire, controlled by an NC control program, through a feed device to a forming device of the spring winding machine, forming a helical spring from the wire with tools of the forming device, defining a desired nominal geometry of the helical spring and an NC control program adapted to produce the nominal geometry, measuring an actual position of a selected structural element of the helical spring relative to a reference element at least one measurement time, which occurs after a start and before an end of production of the helical spring in a measurement area which is at a finite distance from the forming device in a longitudinal direction of the helical spring, wherein the distance is less than an overall length of the finished helical spring, comparing the actual position with a nominal position of the structural element for the measurement time to determine a current position difference, which represents a difference between an actual position and the nominal position at the measurement time, and controlling the position by at least one of the tools of the forming device, which tool determines a pitch of the helical spring as a function of the position difference.

20 Claims, 5 Drawing Sheets

(58) Field of Classification Search
USPC .. 72/17.3–18.2, 135, 137, 142, 145; 29/33 F
See application file for complete search history.

(56) References Cited

U.S. PATENT DOCUMENTS

| | | | | |
|---|---|---|---|---|
| 5,477,715 | A | 12/1995 | Kempf | |
| 5,875,664 | A * | 3/1999 | Scott et al. | 72/16.1 |
| 6,073,056 | A * | 6/2000 | Gawronski et al. | 700/98 |
| 8,136,379 | B2 * | 3/2012 | Itaya | 72/135 |
| 2003/0151739 | A1 * | 8/2003 | Capaldo et al. | 356/239.1 |
| 2006/0230803 | A1 * | 10/2006 | Ruzovic et al. | 72/138 |
| 2008/0302156 | A1 * | 12/2008 | Itaya | 72/135 |
| 2008/0316503 | A1 * | 12/2008 | Smarsh et al. | 356/613 |
| 2011/0214467 | A1 * | 9/2011 | Krueger et al. | 72/19.7 |

FOREIGN PATENT DOCUMENTS

| | | | |
|---|---|---|---|
| DE | 10 2004 042 370 | A1 | 4/2005 |
| JP | 2 192839 | A | 7/1990 |
| JP | 2003-136171 | | 5/2003 |
| JP | 2007-212362 | | 8/2007 |
| WO | WO 02/50494 | A1 | 6/2002 |

OTHER PUBLICATIONS

Japanese Official Action dated Apr. 8, 2014 from corresponding Japanese Patent Application No. 2011-058680.

* cited by examiner 10,424

10,548

METHOD AND APPARATUS FOR PRODUCTION OF HELICAL SPRINGS BY SPRING WINDING

RELATED APPLICATION

This application claims priority of German Patent Application No. 10 2010 014 385.5, filed on Apr. 6, 2010, the subject matter of which is incorporated herein by reference.

TECHNICAL FIELD

This disclosure relates to methods for production of helical springs by spring winding by a numerically controlled spring winding machine and to spring winding machines suitable for carrying out the methods.

BACKGROUND

Helical springs are machine elements required in large quantities and different configurations in numerous fields of application. Helical springs, which are also referred to as wound torsion springs or coil springs, are normally produced from spring wire and are in the form of tension springs or compression springs depending on their load during use. Compression springs, in particular bearing springs, are required, for example, in large quantities for automobile construction. The spring characteristic can be influenced, inter alia, by sections of different pitch or with different pitch profiles. For example, in the case of compression springs, there is frequently a central section of greater or lesser length with a constant pitch (constant section), adjacent to which, at both ends of the spring, there are contact areas with a pitch which becomes less towards the ends. In the case of cylindrical helical springs, the spring diameter is constant over the length of the springs, but it may also vary over the length, for example, in the case of conical or barrel-shaped helical springs. In addition, the overall length of the (unloaded) spring may vary widely for different applications.

Nowadays, helical springs are normally produced by spring winding with the aid of numerically controlled spring winding machines. In this case, a wire (spring wire) is fed, controlled by an NC control program, by a feed device to a forming device of the spring winding machine, and formed with the aid of tools of the forming device, to form a helical spring. The tools generally include one or more variable-position winding pins to fix and possibly to vary the diameter of spring turns and one or more pitch tools, which govern the local pitch of the spring turns in each phase of the manufacturing process.

Spring winding machines are generally intended to produce a large number of springs with a specific spring geometry (nominal geometry) within very narrow tolerances, at a high rate. The functionally important geometry parameters include, inter alia, the overall length of the finished helical spring in the unloaded state. The overall length also governs, inter alia, the installation dimensions of the spring and the spring force.

To comply with stringent quality requirements, for example, in the automobile field, it is normal practice to measure certain spring geometry data, for example, the diameter, length, pitch, and/or pitch profile of the spring after completion of a spring, and to automatically sort the finished springs, depending on the result of the measurement, into satisfactory parts (spring geometry within the tolerances) and unsatisfactory parts (result outside the tolerances), and possibly into further categories. This procedure is highly uneconomic, in particular in the case of long springs, since, in the case of long springs, a relatively great length of wire is consumed for each spring and must be thrown away if it is found that the finished spring is outside the tolerances.

It has also already been proposed for the diameter, the length and the pitch of the spring to be checked by suitable measurement means during manufacture, and for manufacturing parameters to be changed in the event of any discrepancies outside the tolerance limits such that the spring geometry remains within the tolerances. DE 103 45 445 B4 discloses a spring winding machine which has an integrated measurement system with a video camera which is directed at that area of the spring winding machine in which the forming of the spring starts. An image processing system connected to the video camera and having appropriate evaluation algorithms is intended to allow the diameter, length and pitch of the spring to be checked during manufacture, and it is intended to be possible to vary these spring geometry parameters by feedback to the processing tools, which can be adjusted by motors, during manufacture. An evaluation algorithm for determining the current spring diameter is described in detail.

It could therefore be helpful to provide a method and an apparatus of a generic type such that, particularly when producing relatively long helical springs helical springs can be produced within tight geometric tolerances with high reliability, composed of wire materials of widely differing quality. It could also be helpful to provide for the production of long helical springs with little overall length scatter and with a low scrap rate.

SUMMARY

I provide methods of producing helical springs by spring winding with a numerically controlled spring winding machine, comprising: feeding a wire, controlled by an NC control program, through a feed device to a forming device of the spring winding machine; forming a helical spring from the wire with tools of the forming device; defining a desired nominal geometry of the helical spring and an NC control program which is suitable to produce the nominal geometry; measuring an actual position of a selected structural element of the helical spring relative to a reference element at least one measurement time, which occurs after a start and before an end of the production of the helical spring, in a measurement area which is at a finite distance from the forming device in a longitudinal direction of the helical spring, wherein the distance is less than an overall length of the finished helical spring; comparing the actual position with a nominal position of the structural element for the measurement time to determine a current position difference, which represents the difference between the actual position and the nominal position at the measurement time; controlling the position by at least one of the tools of the forming device, which tool determines a pitch of the helical spring, as a function of the position difference.

I also provide spring winding machines that produce helical springs by spring winding controlled by an NC control program, comprising: a feed device that feeds wire to a forming device, wherein the forming device has at least one winding tool, which essentially governs a diameter of the helical spring at a predeterminable position as well as at least one pitch tool, whose action on a helical spring being developed governs local pitch of the helical spring, wherein the spring winding machine is configured to carry out the method.

I further provide a computer program product stored on a computer-readable medium or in the form of a signal, wherein the computer program product results in the computer carrying out my methods when the computer program product is loaded in the memory of a computer and run by a computer of a spring winding machine.

BRIEF DESCRIPTION OF THE DRAWINGS

FIG. 4 shows diagrams of the development over time of the running average value for the actual values, determined in a series of individual measurements, during the manufacture of a spring, wherein

FIG. 5 shows histograms and diagrams relating to the scatter of actual values in a series of individual measurements during the manufacture of a spring, wherein FIG. 4A shows the actual values without control and FIG. 4B shows the actual values obtained with active control.

DETAILED DESCRIPTION

Figure 1:
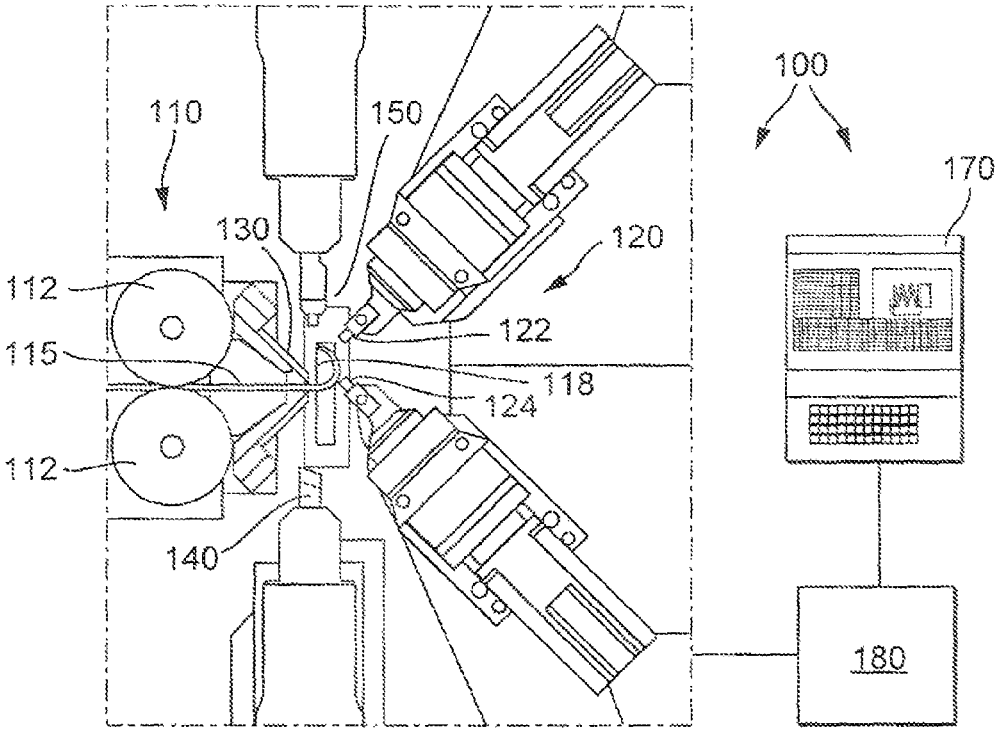
FIG. 1 shows a schematic overview illustration of a spring winding machine with parts of the feed device and of the forming device.

It will be appreciated that the following description is intended to refer to specific examples of structure selected for illustration in the drawings and is not intended to define or limit the disclosure, other than in the appended claims.

In my methods, a desired nominal geometry of the helical spring to be produced and a corresponding NC control program, which is suitable for production of this nominal geometry, are defined. The sequence of coordinated working movements of the machine axes of the spring winding machine which must be carried out during production of a spring is thus defined.

During the production of a helical spring, an actual position of a selected structural element of the helical spring is measured relative to a reference element. The measurement allows an actual distance to be determined between the selected structural element and the reference element. The measurement is carried out at a measurement time which occurs after the start and before the end of the production of the helical spring, that is to say during the course of the working movements, which are intended for spring manufacture, of the spring winding machine. Only a part of the spring has therefore been produced at the measurement time. The selected structural element is in this case located in a measurement area which is a finite distance away from the forming device in the longitudinal direction of the helical spring. This distance is less than the overall length of the finished helical spring, that is to say it is less than the overall length which results from the nominal geometry. A current position difference, which represents the difference between the actual position and the nominal position at the measurement time, is determined by comparison with the actual position of the structural element with a nominal position of the structural element for the measurement time. The position of at least one tool which influences the pitch of the helical spring, of the forming device is then controlled as a function of the position difference to make the actual position approach the nominal position. No control action is taken if the actual value corresponds to the nominal value. In contrast, if a significant discrepancy (position difference) is found, then the pitch of the spring produced at the moment of forming is varied by varying the position of the pitch tool and/or of some other tool which influences the pitch (for example, a winding pin which can be rotated and/or tilted in a controlled form) such that a reduction in the position difference can be expected in the next measurement. The instantaneously produced pitch is therefore controlled on the basis of the measurement. Preferably, only the position of a pitch tool is subjected to open-loop or closed-loop control for this purpose.

Since the measurement area is a finite distance away from the location of the forming process on the forming device, the measurement makes it possible to determine a cumulative length error in the spring section located between the forming device and the measurement area. Since, furthermore, the distance between the measurement area and the forming device is less than the overall length of the finished helical spring, the measurement time can be made sufficiently early with respect to the overall time for production of a helical spring such that a control action which may be carried out on the basis of the measurement can still be used to correct possible incorrect settings during the forming process to keep the overall length of the helical spring within the tolerances after completion of the manufacturing process.

The distance between the measurement area and the forming device is preferably matched to the overall length of the finished helical spring such that this distance is between about 5% and about 70% of the overall length, in particular between about 10% and about 50% of the overall length. If these preferred minimum values for the distance are complied with, a length error can build up over the spring section in the case of imperfect forming conditions which is sufficiently large in comparison to the measurement accuracy of the measurement system to allow significant measurement results. If the preferred upper limits for the distance are complied with then, in general, there is still sufficient remaining time to produce a helical spring with the desired overall length at the end of the manufacturing process, by one or more control actions.

There are preferably one or more spring turns within the distance, as a result of which the measurement area may be located, for example, two, three, four, five, six or more spring turns away from the forming location or the location of the forming device. Valid results can frequently be achieved even at a distance of two to three turns, depending on the pitch.

Preferably, the actual position is measured relative to a machine-fixed reference element. A machine-fixed reference element is an element whose coordinates are known or can be determined with respect to a machine-fixed coordinate system. Since, in this case, the reference element has defined coordinates with respect to the machine coordinate system of the fault winding machine, this measurement is an absolute measurement. This allows particularly high measurement accuracy.

Alternatively, the reference element may also be a structural element of the helical spring, in particular a turn section located relatively close to the forming device, or the contour of a turn section. In this case, a relative measurement is carried out. To ensure that any possible accumulated length error between the structural element selected for the measurement and the reference element is sufficiently large to allow reliable measurement, there should be a plurality of turns, for example, two, three, four, five or more turns between the structural element and the reference element.

The measurement is preferably carried out contactlessly, in particular by optical measurement means. For example, a laser measurement system could be used for this purpose. A camera with a two-dimensional field of view (viewing area, coverage area) is preferably used for measurement, and the measurement area is placed in the field of view of the camera. Camera-based measurement systems with powerful image processing hardware and software are commercially available and can be used for this purpose. The camera should be attached to a mount with as little vibration as possible, with the mount being firmly connected to the frame of the spring winding machine during operation. The camera is preferably seated adjacent to or on a longitudinal guide which allows the camera to be fixed at different distances from the forming device to allow the respectively optimum distance to be set for different spring geometries. The mount position can be vertically adjustable, for example, to allow matching to springs of different diameter. An adjustment device should also allow the mount to be arranged inclined obliquely with respect to the spring axis, if required.

In some instances, the reference point for the measurement is located at the edge of the, for example, rectangular field of view of the camera, which has known coordinates with respect to the machine coordinate system. In this case, a virtual reference element is formed by the edge of the field of view, preferably by that side edge of the field of view which faces the forming device. The measurement of the actual position of the structural elements can then be reduced to a simple distance measurement within the field of view.

In others, which can be used alternatively or additionally, a machine-fixed reference body is provided, and is positioned in the field of view of the camera at a distance from the measurement area, with a structural element of the reference body, for example, a straight edge being used as a reference for the measurement. Any vibration of the camera during the measurement cannot affect the measurement accuracy of the measurement in this method variant, because this vibration will have no influence on the distance as can be seen in the field of view of the camera between the structural element of the helical spring that is used as the basis for the measurement and a reference point on the reference body.

When using a 2D camera for measurement, it has been found to be particularly advantageous for the selected structural element of the helical spring used for the measurement to be a contour section of a spring turn which appears more or less as a straight line in the field of view and runs transversally with respect to the longitudinal direction of the spring, in particular at an angle of between about 45° and about 90° to the longitudinal direction of the helical spring. This allows simple image processing system contour detection algorithms to determine the actual position of the structural element in the longitudinal direction of the spring very accurately. For example, alternatively, it would also be possible to place the measurement area at the outer edge of a spring turn, to determine the location of the maximum distance (maximum location) of this turn section from the longitudinal axis of the helical spring, and to determine the distance between this maximum location and the reference element.

The nominal position of the structural element at the measurement time should be known as accurately as possible to allow objective control of the manufacturing process. The nominal position of the structural element is preferably known for every time during the manufacturing process, thus allowing the nominal position at the measurement time to be derived directly from a corresponding program-time function. When manufacturing helical springs which have a greater or lesser constant length section (section of constant pitch), the measurement preferably starts only when a variable pitch spring section which may be present has passed through the measurement area. When carrying out measurements in the constant section, it is possible to make use of the fact that the nominal position of a selected structural element remains constant over a relatively long time, thus resulting in relatively simple measured value acquisition and evaluation. In principle, it is also possible to carry out measurements in spring sections with pitch changes. This generally results in nominal positions which vary, that is to say move, over time, and which are then used as the basis for the comparison step with the nominal value that is applicable to the measurement time.

In general, the coordinates of the nominal position of the structural element at the measurement time are derived from a program-time function, which is determined before the measurement, for the coordinates of the nominal position of the structural element. The correct nominal value can then be determined uniquely for each measurement time. The program-time function for the coordinates of the nominal position can be determined on the basis of a simulation based on a computer. However, in general, an experimental determination is possible and worthwhile within a relatively short time. In some instances, the program-time function for the coordinates of the nominal position of the structural element is determined on the basis of a reference production process of at least one reference helical spring, that is to say experimentally.

The expression "program-time function" in this case refers to a function which relates to specific points within the NC control program. In this case, the reaching of a specific NC set corresponds to a specific program time or a time within the program sequence. To this extent, a program time corresponds to a sequence position in the sequential processing of program steps during the running of the program. If, for example, a trigger signal is required to control an image recorded by a camera in a specific phase of running of the program, then this trigger signal can be triggered by a program line before the appropriate point. Signals such as these are directly linked in the program to specific positions of the machine axes, for example, to the machine axis of the wire feed and/or to the machine axis for the position of the pitch tool. A time in a program-time function therefore corresponds to a location on the movement curve of one or more machine axes. The program-time function results in times (program times) within an NC program, which are synchronous with the progress of the spring production. To this extent, the program-time function is also a movement function with respect to the movements of machine axes. In particular, a program-time function also corresponds to a movement function of the wire feed.

In some manufacturing processes, for example, in the case of relatively short helical springs, a single measurement and a single control action carried out as required after the measurement may be sufficient to produce a helical spring with a sufficiently small length error. Particularly in the case of relatively long helical springs, a plurality of measurements are carried out at successive measurement times with a time interval between them during the manufacture of the helical spring, thus making it possible to observe the rate of change of the spring geometry during the manufacturing process, and to carry out a plurality of control actions if necessary.

The number of measurements per unit time is in theory limited by the recording and evaluation capacity of the measurement system. However, it has been found that a high measurement frequency is generally neither necessary nor worthwhile. Preferably, the time interval between immediately successive measurement times is matched to the feed rate of the wire such that at least one turn is produced in a time interval between two immediately successive measurements, preferably between one and two turns being produced in the time interval. This makes it possible to ensure that any accumulated length error are then sufficiently great to allow them to be reliably detected within the scope of the measurement accuracy of the measurement system. The significance of the measurement results is thus improved, and the control process operates in a more stable form.

A plurality of measurements are preferably carried out during the production of a constant section of the helical spring. In these conditions, an observed structural element should not change its positions over a certain time. The nominal value used for the comparison step remains constant during this time.

If the structural element moves in the direction of the forming device during the manufacture of a constant section, then this indicates that the pitch during the forming process is too small, and this can be appropriately corrected. Conversely, movement of the structural element away from the forming device can be compensated for by reducing the pitch.

In some instances, a running average value for the actual values is determined from the actual values of a plurality of successive measurements after a predefined number of measurements, in particular after each measurement. Valid information relating to the effectiveness of the control action can be derived from this running average value. A development of the running average value over time is preferably displayed on a display unit of the spring winding machine. An operator can see directly from this whether the settings implemented on the control device are adequate for effective control to obtain a helical spring with the desired overall length at the end of a manufacturing step.

Various control concepts and control algorithms can be implemented. In some instances, a weighted difference value is determined for each determined position difference, and the position of the tool is changed on the basis of the weighted difference value. In particular, a weighted difference value which is proportional to the position difference can be determined, wherein a proportionality factor can preferably be set by the operator, and can be varied as required. Any discrepancy from the nominal value found in a measurement may lead to a control action, thus making it possible to react quickly to discrepancies. It is also possible to correct the position of the tool only when the position difference or a weighted difference value derived from it exceeds a specific threshold value.

To avoid a permanent control error, the control errors are preferably integrated over time in the form of an I-controller, thus making it possible to produce the control characteristic of a PI-controller overall.

I also provide numerically controlled spring winding machines particularly configured for carrying out the method. These machines have a feed device for feeding wire to a forming device, as well as a forming device with at least one winding tool, which essentially governs the diameter of the helical spring at a predeterminable position, as well as at least one pitch tool, whose action on the helical spring which is being developed governs the local pitch of the helical spring.

The spring winding machines preferably have a first camera arranged such that a measurement area in the field of view of the camera records a part of a spring section at a finite distance from the tools of the forming device. The distance between the measurement area and the forming device is preferably matched to the overall length of the finished helical spring such that the distance is between about 5% and about 70%, in particular between about 10% and about 50% of the overall length, and/or such that there are one or more spring turns within the distance, for example, at least two or three spring turns. Furthermore, a second camera can be provided, and is positioned at a distance from the first camera such that a free spring end section runs into the coverage area of the second camera in a final phase of the production of the helical spring. When using a camera with a sufficiently large coverage area, a single camera may be sufficient to cover the measurement area, which is at a finite distance from the tools of the forming device, and the measurement area for detecting the end section.

In some modern CNC spring winding machines which already have a suitable measurement system with a camera, my methods can be implemented subject to already existing design preconditions. I provide the capability of implementing additional program parts or program modules, or a program modification in the control software of computer-aided control devices.

I further provide computer program products stored in particular on a computer-readable medium or in the form of a signal, wherein the computer program products results in the computer carrying out my methods or preferably to products loaded in the memory of a suitable computer and run by a computer of a spring winding machine.

These and further features are disclosed not only in the appended claims, but also in the description and the drawings, wherein the individual features can in each case be implemented on their own or in groups of two or more in the form of sub-combinations for an example, and in other fields.

Turning now to the drawings, the schematic overview illustration in FIG. 1 shows major elements of a CNC spring winding machine 100 based on a design known per se. The spring winding machine 100 has a feed device 110 which is equipped with feed rollers 112 and feeds successive wire sections of a wire 115, which comes from a wire supply and is passed through a directing unit, with a numerically controlled feed rate profile into the area of a forming device 120. The wire is formed with the aid of numerically controlled tools in the forming device, to form a helical spring. The tools include two winding pins 122, 124, which are arranged offset through an angle of about 90°, are aligned in the radial direction with respect to the center axis 118 (corresponding to the position of the desired spring axis), and are intended to determine the diameter of the helical spring. The position of the winding pins can be varied for basic adjustment for the spring diameter during the setting up process along the movement lines shown by dashed-dotted lines and in the horizontal direction (parallel to the feed direction of the input 112) to set the machine up for different spring diameters. These movements can also be carried out with the aid of suitable electrical drives, monitored by the numerical control system.

A pitch tool 130 has a tip which is aligned essentially at right angles to the spring axis and engages in the developing spring alongside the turns. The pitch tool can be moved with the aid of a numerically controlled movement drive for the corresponding machine axis parallel to the axis 118 of the developing spring (that is to say at right angles to the plane of the drawing). The wire which is sent forward during spring production is forced in a direction parallel to the spring axis by the pitch tool, corresponding to the position of the pitch tool, with the local pitch of the spring in the corresponding section being governed by the position of the pitch tool. Pitch changes are produced by moving the pitch tool parallel to the axis during spring production.

The forming device has a further pitch tool 140, which can be applied vertically from underneath and has a wedge-shaped tool tip which is inserted between adjacent turns when this pitch tool is being used. The adjustment movements of this pitch tool run at substantially right angles to the axis 118. This pitch tool is not used in the illustrated production process.

A numerically controllable separating tool 150 is fitted above the spring axis and cuts the helical spring that has been produced off from the wire supply being fed, with a vertical working movement, after completion of the forming operations. In FIG. 1, the wire which has been fed is shown in a situation immediately after the previously completed helical spring has been cut off. In this position, the wire has already formed half a turn, and the wire end which forms the spring start is located 0.3 turns before the position of the pitch tool 130.

The machine axes of the CNC machine which belong to the tools are controlled by a computer-numerical control device 180 which has memory devices in which control software resides including, inter alia, an NC control program for the working movements of the machine axes.

To manufacture a helical spring, starting from the "spring complete position" shown, the wire is fed in the direction of the winding pins 122, 124 with the aid of the feed device 110, and is deflected by the winding pins to the desired diameter, forming a curve in the form of a circular arc until the free wire end reaches the pitch tool 130. When the wire is fed further, the axial position of the pitch tool determines the current local pitch of the developing helical spring. The pitch tool is moved axially under the control of the NC control program when it is intended to change the pitch during spring development. The actuating movements of the pitch tool essentially govern the pitch profile along the helical spring.

When setting up the spring winding machine, the forming tools are moved to their respective basic settings. In addition, the NC control program is created or loaded, controlling the actuating movements of the tools during the manufacturing process. The geometry input for the spring winding machine is carried out by an operator on the display and control unit 170, which is connected to the control device 180.

Figure 2:
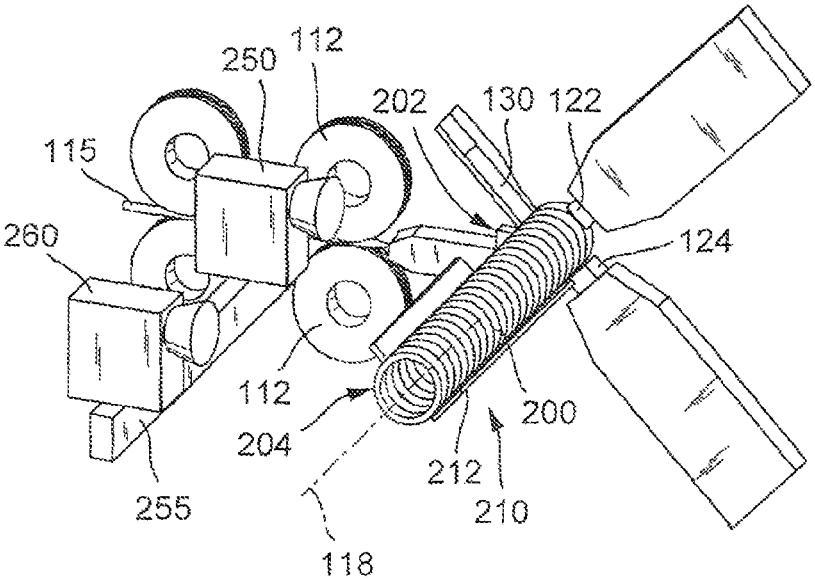
FIG. 2 shows a perspective illustration of fittings for the spring winding machine shown in FIG. 1, including two cameras of a camera-based, optical measurement system for contactless real-time recording of data relating to the geometry of a spring which is currently being produced, and a spring guide device.

A number of fittings which are advantageous for implementation of the method for the spring winding machine as shown in FIG. 1 will now be explained with reference to FIG. 2. The elements which are already known from FIG. 1 are annotated with the same reference symbols as in FIG. 1. FIG. 2 shows the spring winding machine during the production of a relatively long, cylindrical helical spring 200, of which approximately 20 turns have already been produced at the time shown in the figure. This is a long spring with an L/D ratio between the overall length L of the completed spring and the diameter D of the spring of more than ten. To ensure that the spring, which becomes ever longer as the wire feed increases, remains straight and that its free end does not bend downward, a spring guide device 210 is provided. The spring guide device has an angle plate 212, which is attached with the horizontal longitudinal axis to the frame of the spring winding machine, and has a V-shaped profile. The flat inclined surfaces of the angle plate which run together downward support the spring at the bottom and at the side such that the longitudinal axis (central axis) of the developing spring runs coaxially with respect to the center axis 118 of the developing spring. The angle plate is attached to the machine frame by a holding device, which is not shown, and it can be adjusted in height and in lateral direction to allow the desired guidance, coaxial with respect to the center axis 118 of the spring, for springs of different diameter. After completion of the process of manufacturing a spring, the angle plate can automatically be pivoted downward by a hydraulic pivoting drive to allow the finished spring to slide into a collecting container.

That end of the angle plate which faces the forming device is located with a clear separation of a few centimeters away from the forming device, such that a freely floating spring section 202 remains between the tools of the forming device and the machine-side start of the angle plate. The length of the angle plate is matched to the overall length of the finished helical spring such that the spring end section manufactured first projects freely beyond that end of the angle plate which is remote from the machine during the final manufacturing phase. The freely floating spring section 202 close to the machine and the spring end section 204 remote from the machine are thus accessible for an optical measurement with a viewing direction at right angles to the longitudinal axis of the helical spring.

The spring winding machine is equipped with a camera-based, optical measurement system for contactless real-time recording of data relating to the geometry of a spring currently being produced. The measurement system has two identical CCD video cameras 250, 260 which, in the example, with a resolution of 1024×768 pixels (image elements) can supply up to about 100 images per second (frames per second) via an interface to a connected image processing system. The recording of the individual images is in each case triggered via trigger signals from the control system. This defines the measurement times. The image processing software is accommodated in a program module which interacts with the control device 180 for the spring winding machine, or is integrated in it.

Both cameras are mounted on a mounting rail 255 which is resistant to twisting and is attached at the side to the machine frame of the spring winding machine, adjacent to the spring guide device in the area of the guide rollers of the feed device, such that the longitudinal axis of the mounting rail runs parallel to the machine axis 118. The measurement cameras can be moved longitudinally on the mounting rail and can be fixed at any desired selectable longitudinal positions.

Figure 3:
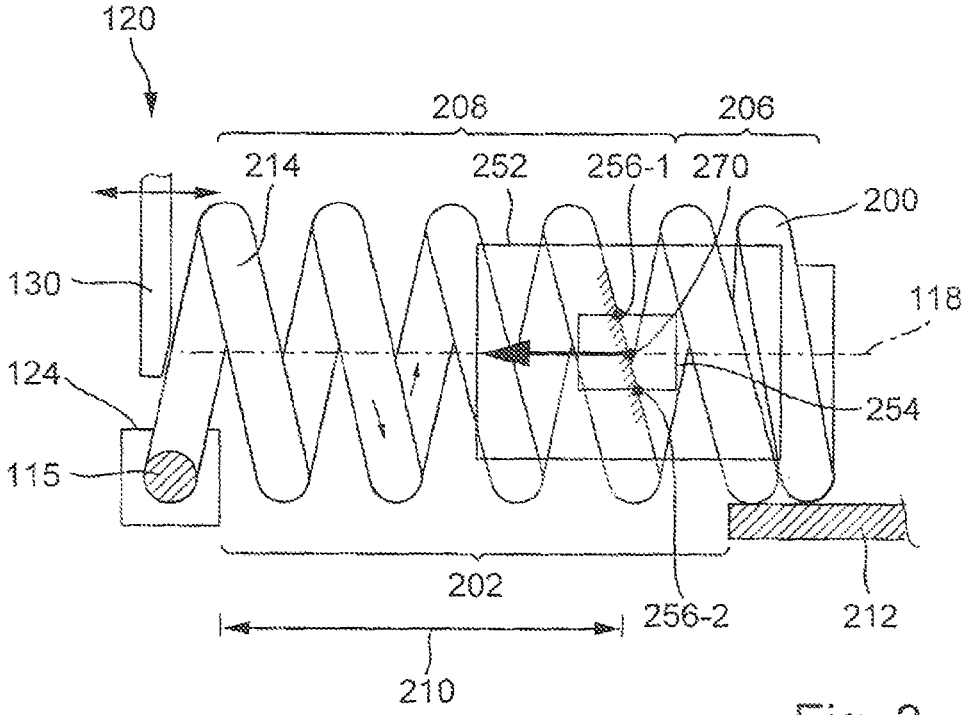
FIG. 3 shows a spring section, produced by the forming device, of the spring currently being produced from a viewing direction parallel to the direction of the wire feed and parallel to the optical axis of the camera optics of the first camera, wherein one turn section of the spring is located in a measurement area which is located within the field of view of the camera.

The first camera 250, which is close to the machine, is fitted such that its rectangular field of view 252 (image coverage area) covers a part of the freely floating spring section 202 at a distance from the forming tools (see FIG. 3). The optical axis of the camera optics in the example is arranged approximately at the same level as the center axis of the helical spring (that is to say at the level of the axis 118) and runs at right angles to this axis. A smaller, rectangular measurement area 254 can be seen within the rectangular field of view 252, through which measurement area 254 a turn section of the spring facing the camera runs obliquely from top left to bottom right. The image of this turn section (which moves in the longitudinal direction of the wire during spring production) or its contour remote from the machine is used as a structural element for the length measurement.

The second camera 260 is intended to record the free spring end 204 and therefore positioned on the mounting rail such that the free spring end runs into the coverage area of the second camera during the final phase of production of the helical spring.

An illumination device is fitted at the height of the axis 118 diametrically opposite the camera, providing illumination in the form of a flash at the measurement times predetermined by the control system as a reaction to trigger signals from the control system, allowing transmitted-light measurement. A front-lighting device can be provided on the side of the cameras to improve the visibility of interesting details of the spring for measurement.

FIG. 3 shows the situation illustrated in FIG. 2, from a viewing direction parallel to the direction of the wire feed (C axis of the spring winding machine) or parallel to the optical axis of the camera optics of the first camera. A section through the wire 115 can be seen on the left, which is fed in the feed direction (at right angles to the plane of the drawing) to a curved inclined surface of the lower winding tool 124. The winding tool forces the wire upward onto a path, which is curved in a circular shape, in the direction of the upper winding tool, and in the process is permanently formed. The tip of the pitch tool 130 can be seen above the winding tool, and a side working surface of the winding tool rests on the developing turn. The pitch tool can be moved parallel to the spring axis 118 (in the direction of the arrow) under NC control, with the aid of the associated machine axis, such that the local pitch of the spring at the forming location is governed by the position of the pitch tool.

FIG. 3 shows an initial phase of manufacturing a cylindrical helical spring 200, which has a contact section 206, which has already been produced at the end, with a continuously increasing pitch, followed by a constant section 208 with a constant pitch, and an opposite contact section, which has not yet been manufactured at the illustrated time, with a decreasing pitch. At the illustrated time, the manufacturing process has already progressed to such an extent that the free spring end with the contact section passes the measurement area 254, and has already reached the angle plate of the spring guide device, and the free-floating spring section 202 with a constant pitch is thus located in a stable form, coaxially with respect to the axis 118.

The first camera 250 is aligned such that the measurement area 254 is at a relatively great distance 210 from the tools 122, 130 of the forming device when viewed in the longitudinal direction of the helical spring. In this example, there are approximately four turns of the helical spring in this distance. In this example, the distance is between about 10% and about 20% of the overall length of the finished spring, and in particular in the case of short springs it may, for example, also be up to about 30%, about 40% or about 50% of the overall length.

The following procedure can be adopted for large-scale production of helical springs with the aid of this spring winding machine. First, the desired nominal geometry of the helical spring is entered on the display and control unit 170, or appropriate already available geometric data is loaded from a memory of the spring winding machine, for example, by inputting an identification number. An NC generator uses the geometric data as the basis for calculating an NC control program, whose individual NC sets and the sequence thereof in the subsequent manufacturing process control the coordinated working movements of the devices and tools of the spring winding machine.

After the tools of the forming device have been set up, a first helical spring is manufactured in a first reference manufacturing process without activating the control system fitted with the measurement system. In this case, the measurement area 254 of the first camera 250 records a selected structural element of the spring, in the example the turn section which runs obliquely through the measurement area from top left to bottom right. This appears dark in the camera image, and is clearly evident from the bright background, with a light/dark contour of straight lines being formed. To improve the capability to identify the contours, the helical spring can be illuminated on the side of the camera and/or in the interior in the area of the measurement area. The boundary remote from the machine which appears in the field of view, or the edge of this turn section, is used to determine the actual position of the structural element. In this case, by way of example, the image processing system can determine the coordinates of the upper intersection 256-1 and of the lower intersection 256-2 of the light/dark transition respectively with the upper and lower boundary of the measurement area, and the coordinates of the straight-line area located in between are determined by interpolation. The distance parallel to the axis to a reference point that is remote from the machine is then determined with the aid of a "distance tool" in the image processing software for a measurement point 270 which is located centrally between the upper and the lower intersections, to obtain a first actual value for the position of the structural element. In the example shown in FIG. 3, the straight-line boundary of the field of view 252 close to the machine (on the left) is used as a virtual reference element, or as a "fixed stop," for the measurement. The distance measured parallel to the axis (to the axis 118) between the measurement point 270 on the selected structural element and the reference element is then adopted by the control system as the first nominal value for the further manufacture.

The overall length of the finished spring is then measured independently. If this overall length is within the predetermined tolerance, it is assumed that the measured first nominal value can be adopted as a start value for the subsequent large-scale manufacture. In contrast, if the overall length is outside the tolerance, then the settings for the manufacturing process are changed to allow a corresponding further reference measurement to be carried out for a subsequent spring. These individual reference measurements are repeated in steps until a manufactured spring is very well within the manufacturing tolerance for the overall length of the helical spring. The nominal value for the structural element determined during the manufacture of this "satisfactory" spring is then adopted for large-scale manufacture.

In this case, in the example, care must be taken to ensure that the nominal value is determined at a time when the constant section 208 of the spring is already located in the measurement area 254. In these conditions, the absolute value of the nominal dimension is then constant over a relatively long time interval, as a result of which, ideally, nothing changes in the appearance of the projection of the developing spring as recorded by the camera, as long as turns of the constant section are moving through the coverage area of the camera.

The control system can then be set and can be activated to manufacture subsequent springs in a batch. In this case, a measurement expediently starts only when a contact area which may be present with an increasing pitch has moved through the measurement area, and the measurement area is located in the constant part of the spring. After this, the control cycle then starts with a first measurement of the actual distance between the selected structural section and the defined reference element (edge of the field of view). The determined actual position or the determined actual distance is then compared by evaluation software with the previously determined nominal position or the nominal distance of the structural element for the measurement time. This computational comparison produces a value for a current position difference, which represents the difference between the actual position and the nominal position at the measurement time. In the following example, the numerical details are in each case quoted without any dimension, for clarity reasons, although, for example, the dimension is millimeters.

If, for example, the nominal value is 10.5 and the actual value is 10.7, then the position difference is −0.2. A weighted difference value is determined from this position difference. For this purpose, in the example, a weighting parameter which can be set by the operator and is referred to as the "control step" is used, which is defined as a percentage and is applied to the determined position difference. For example, if a control step of 50% is set, then a position difference of −0.2 results in a weighted difference value of −0.1. This value which remains after weighting is now added to a correction value, to obtain a new (modified) correction value. Initially, for example, the correction value can be set to the value 0 (zero), and is then changed in steps during the control process. In the example (correction value initially 0) a new correction value is calculated using the computational relationship 0+(−0.1)=(−0.1), which is then sent as a correction to the control system of the spring winding machine.

The NC control program is prepared at predetermined points for the control system such that the programmable logic controller (PLC) in the NC program can immediately change an NC set corresponding to the received correction value. This change acts directly (in real time) on the position of the pitch tool 130, in the sense of reducing the position difference.

In the immediately subsequent second measurement, an actual position with the actual size 10.6 is determined, for example. With the nominal value of 10.5, which is still valid, this results in a position difference of −0.1. With the weighting factor unchanged (control step 50%), this results in a weighted difference value of −0.05, and therefore a correction value of: (−0.1)+(−0.05)=−0.15. As can be seen, the renewed correction does not act on the original correction value (=0) but on the correction value (−0.1) which has been changed on the basis of the previous measurement. After the second measurement, a correction value of −0.15 is therefore sent as the correction to the control system, and is processed in the already described manner for direct changes to the NC control program.

This processing of measurement data which has been explained using an example corresponds to a PI regulator with a variable proportional component and the integrating effect of an integral component.

These steps are now carried out at a number of successive measurement times separated by a time interval during the manufacture of the constant section of the helical spring, thus carrying out or making it possible to carry out a multiplicity of control actions. The wire is fed forward continuously during the measurements, and no stopping is necessary. The time interval between the successive measurement times in this method variant is matched to the feed rate of the wire such that approximately 1.4 turns are produced between two immediately successive measurement times. This measurement sequence, which is relatively slow in comparison to the possible frame rate of the camera, makes it possible for an error to possibly build up in the spring between the individual measurements, if the process sequence is not optimal, of sufficient size to lead to a significant measured value within the scope of the measurement accuracy of the system, thus resulting in a correction of the correct magnitude being initiated in the correct direction.

Figure 4A:
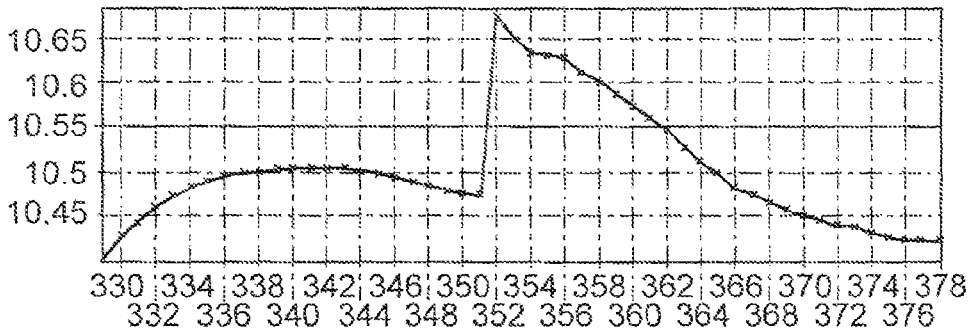
FIG. 4A shows the development over time without control.

The precision-increasing effect of this control process can be demonstrated with reference to FIGS. 4A, 4B and 5A, 5B. These figures show measurement results which were obtained during the production of clutch damper springs with 47 turns composed of spring wire with a diameter of 3.8 mm. The springs had a diameter of about 27 mm and an overall length of about 350 mm. The diagrams in FIGS. 4A and 4B each show the time development of the running average value for the actual values determined for the individual measurements during the manufacture of a spring. Dimensionless numbers for equidistant measurement times are in each case shown on the abscissa, such that the abscissa is a time axis. The ordinate in each case shows the values for the running average of the actual value in comparison to the nominal value of 10.55 mm, which is shown as a bold line. FIG. 4A shows a typical measurement diagram for conventional manufacture without control. The manufacture of a new helical spring starts at the time numbered 351. The final phase of the previous manufacturing process is shown to the left of this, ending with an average value which is too low (approximately 10.48 mm), as a result of which the manufactured overall length of this spring is too short. Initially, the actual values for the new helical spring are too high, the running average first of all approaches the nominal value and then, however, undershoots it to an ever greater extent as the distance increases, as a result of which this helical spring is also considerably too short after completion.

Figure 4B:
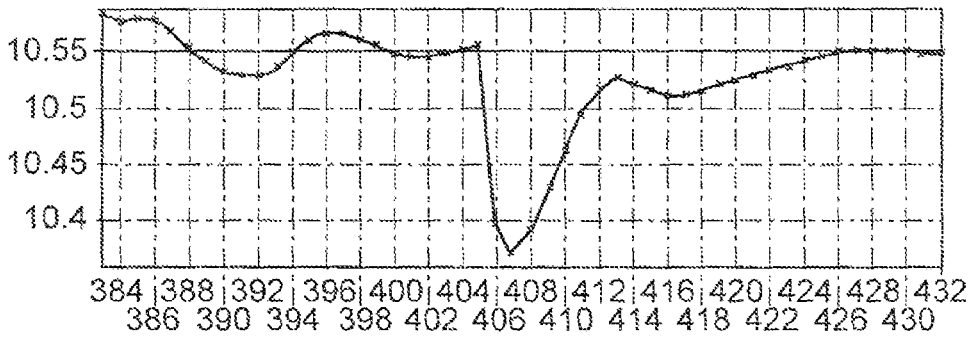
FIG. 4B shows the developments over time with active control.

FIG. 4B shows the corresponding illustration for manufacture with the control system switched on. The manufacture of the previous spring ends at the time numbered 405 at an average value which is very close to the nominal value, as a result of which the overall length of the spring is very close to the nominal value for the overall length. During the manufacture of the next helical spring, the actual values are initially considerably below the nominal value. However, the control action leads to the running average approaching the nominal value (10.55 mm) after the third measurement, with the running average asymptotically approaching the nominal value towards the end of the manufacturing process, with the running average value once again corresponding virtually exactly to the nominal value at the end of the manufacturing process.

Figure 5A:
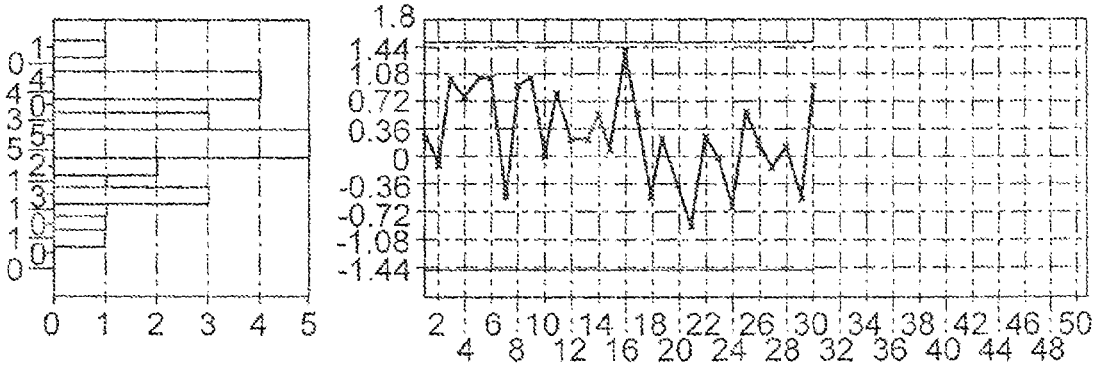
Figure 5B:
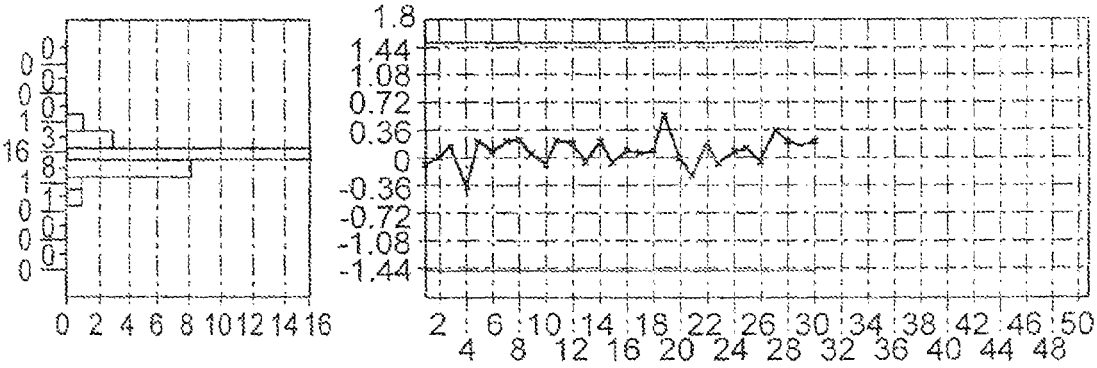

FIGS. 5A and 5B use a different illustration to show the effect of the control system, with FIG. 5A in each case showing the results without the control system and FIG. 5B showing the results with the control system switched on. The diagrams shown on the right in each case once again show the measurement times in arbitrary numerical units on their abscissa, and the respectively measured position difference between the actual value and the nominal value on the ordinate. The bold lines running parallel to the zero line above and below represent the tolerance band limits for the manufacturing process. The measurement results are shown in the form of histograms in each of the figure elements on the left. During the manufacturing process without the control system shown in FIG. 5A, the actual values are widely scattered in both directions around the nominal value, although all the values are within the tolerances. When the control system is activated (FIG. 5B), the resultant scatters around the nominal value are significantly less, thus ensuring that all of the helical springs manufactured with the aid of the control system have an overall length very close to the nominal value for the overall length.

Figure 6:
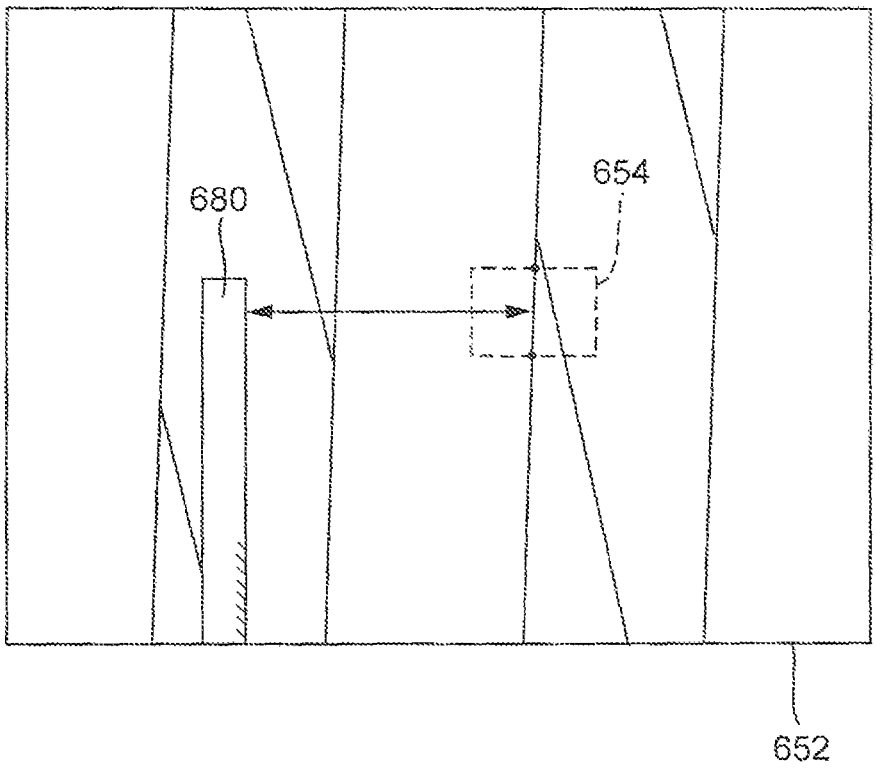
FIG. 6 shows a rectangular field of view of the first camera, wherein a section of a spring to be measured and the image of a reference element, which is mounted fixed to the machine, can be seen in the field of view.

The first camera 250 is arranged relatively close to the forming tools on the mounting rail 255, as a result of which any oscillations at the location of the first camera can have only small amplitudes which have scarcely any adverse effect on the measurement accuracy. Nevertheless, the measurement result can be adversely affected by movements of the camera. Reference is made to FIG. 6 to explain one possible way to make the measurement result independent of any camera oscillations, and thus to improve the measurement accuracy. The illustration shows a rectangular field of view 652 of the first camera. A smaller rectangular measurement area 654 encloses a contour, which runs virtually vertically from top to bottom, of a turn section which is located in the focus area of the camera and faces the camera. The coordinates of the actual position of the observed structural element of the spring are determined by interpolation between the intersections of the light/dark contour with the upper and lower edges of the measurement area. Furthermore, the image of a reference element 680 can be seen in the field of view, formed by a vertically aligned bolt which is attached to the machine frame with the aid of a stable mount. The bolt projects from underneath into the field of view and, in the focus zone of the camera, forms a sharply imaged, vertical contour with a light/dark transition. The distance between the structural element and that edge of the reference element 680 which faces the structural element is now determined in the measurement, and is used as the actual dimension for evaluation. This measured distance is independent of any oscillations of the camera and any movements of the field of view associated therewith relative to the observed spring. Any movements of the camera are therefore excluded from the measurement error.

The measurements of the distance between the structural element of the helical spring (for example, the contour of a turn section) and a virtual or physically present reference element can be carried out, as described, in a direction parallel to the axis 118 or else obliquely thereto, in suitable other directions.

The examples which have been described in detail have been explained on the basis of production of a long spring with more than 30 turns. A helical spring with a length of about 65 mm and with only 7 turns was produced during trials that are not shown in the figures. Measurements were carried out at only two times during production with appropriate correction. It was possible to reduce the scatter in the overall length from about 0.3 mm without control to about 0.15 mm with control.

Alternatively or in addition to the described absolute measurement relative to a machine-fixed reference element, a relative measurement with respect to a reference element is also possible in some cases, with the reference element being formed by a part of the spring. For example, if the field of view 252 as shown in FIG. 3 is sufficiently large to cover more turns in the longitudinal direction of the spring, the length separation between the measurement point 270 on the turn contour located in the measurement area 254 and a corresponding turn contour which is located closer to the forming tools and is 3 or 4 turns away could be measured and used as the basis for the control process. By way of example, the first complete turn 214 or its contour remote from the machine could thus be used as a reference element.

The above description of the preferred structures and methods has been given by way of example. From the disclosure given, those skilled in the art will not only understand my machines and methods and their attendant advantages, but will also find apparent various changes and modifications to the structures and methods disclosed. It is sought, therefore, to cover all changes and modifications as fall within the spirit and scope of the disclosure, as defined by the appended claims, and equivalents thereof.

What is claimed is:

1. A method of producing helical springs by spring winding with a numerically controlled spring winding machine comprising:

defining a desired nominal geometry of a helical spring and defining a corresponding NC control program adapted to control the spring winding machine so a to produce helical springs having the nominal geometry when the spring winding machine operates under control of the NC control program;

feeding a wire, controlled by the NC control program, through a feed device to a forming device of the spring winding machine;

forming a helical spring from the wire with tools of the forming device;

measuring an actual position of a selected structural element of the helical spring relative to a reference element by measuring a distance between the selected structural element and the reference element at at least one measurement point in time, which occurs after a start and before an end of production of the helical spring in a measurement area which is at a finite distance from the forming device in as longitudinal direction of the helical spring, wherein the distance is less than an overall length of the finished helical spring;

comparing the actual position with a nominal position of the structural element for the measurement point in time to determine a current position difference, which represents a difference between an actual position and the nominal position at the measurement point in time; and controlling the position by at least one of the tools of the forming device, which tool or tools determines a pitch of the helical spring as a function of the position difference.

2. The method according to claim 1, wherein the distance between the measurement area and the forming device is matched to the overall length of the finished helical spring such that the distance is between about 5% and about 70% of the overall length.

3. The method according to claim 1, wherein the distance between the measurement area and the forming device is such that there is at least one spring turn within the distance.

4. The method according to claim 1, wherein the measuring is performed using a camera with a two-dimensional field of view for measurement, and the measurement area is located in the field of view of the camera.

5. The method according to claim 4, wherein the selected structural element of the helical spring used for the measurement is a contour of a turn section which appears as a straight line in the field of view and runs transversally with respect to the longitudinal direction of the helical spring.

6. The method according to claim 1, wherein the actual position is measured relative to a machine-fixed reference element.

7. The method according to claim 6, further comprising measuring the actual position with respect to a virtual reference element formed by an edge of the field of view of a camera.

8. The method according to claim 6, further comprising:

providing a machine-fixed reference body positioned at a distance from the measurement area in the field of view of the camera, and one element of the reference body is the reference element for the measurement.

9. The method according to claim 1, wherein coordinates of the nominal position of the structural element at the measurement point in time are derived from a program-time function which is defined before the measurement for coordinates of the nominal position of the structural element.

10. The method according to claim 9, wherein the program-time function for the coordinates of the nominal position of the structural element is determined experimentally on the basis of at least one reference production process of a reference helical spring.

11. The method according to claim 1, wherein a plurality of measurements are carried out during the manufacture of the helical spring at successive measurement points in time with a time interval there between.

12. The method according to claim 11, wherein the time interval is matched to a feed rate of the wire such that at least one turn is produced in a time interval between two immediately successive measurements.

13. The method according to claim 11, wherein a plurality of measurements are carried out during production of a constant section of the helical spring.

14. The method according to claim 11, further comprising:

determining a running average value for the actual values from the actual values of a plurality of successive measurements after a predefined number of measurements.

15. The method according to claim 14, further comprising:

displaying a development of the running average value over time on a display unit of the spring winding machine.

16. The method according to claim 1, further comprising:

determining a weighted difference value proportional to a position difference for each determined position difference, and changing position of the tool on the basis of the weighted difference value.

17. A spring winding machine that produces helical springs by spring winding controlled by an NC control program comprising:

a forming device for forming a helical spring from a wire having at least one winding tool which controls a diameter of the helical spring at a predeterminable position as well as at least one pitch tool whose action on a helical spring being developed governs local pitch of the helical spring;

a feed device controlled by the NC control program that feeds wire to the forming device;

a measuring device for measuring an actual position of a selected structural element of the helical spring relative to a reference element by measuring a distance between the selected structural element and the reference element at at least one measurement point hi time, which occurs after a start and before an end of production of the helical spring in a measurement area which is at a finite distance from the forming device hi a longitudinal direction of the helical spring, wherein the distance is less than an overall length of the finished helical spring;

wherein the NC control program is configured to produce a desired nominal geometry of the helical spring by:

comparing the actual position with a nominal position of the structural element for the measurement point in time to determine a current position difference, which represents a difference between an actual position and the nominal position at the measurement point in time; and controlling the position by at least one of the tools of the forming device, which tool or tools determines a pitch of the helical spring as a function of the position difference.

18. The spring winding machine according to claim 17, further comprising:

a first camera arranged such that a measurement area in a field of view of the first camera records a part of a spring section at a finite distance from the tools of the forming device, wherein at least one of the following condition holds for the distance:

(i) the distance is matched to an overall length of a finished helical spring such that the distance is between about 5% and about 70% of the overall length;

(ii) the distance is such that there are one or more spring turns within the distance.

19. The spring winding machine according to claim 18, further comprising:

a second camera positioned at a distance from the first camera such that a free spring end section runs into a field of view of the second camera in a final phase of production of the helical spring.

20. A non-transitory computer-readable medium for providing instructions for a spring winding machine carrying out a spring winding method when loaded in a memory of a computer of the spring winding machine, the instructions comprising:

feeding a wire through a feed device to a forming device of the spring winding machine;

forming a helical spring from the wire with tools of the forming device;

defining a desired nominal geometry of the helical spring;

measuring an actual position of a selected structure element of the helical spring relative to a reference element by measuring a distance between the selected structural element and the reference element at at least one measurement point in time, which occurs after a start and before an end of production of the helical spring in a measurement area which is at a finite distance from the forming device in a longitudinal direction of the helical spring, wherein the distance is less than an overall length of the finished helical spring;

comparing the actual position with a nominal position of the structural element for the measurement point in time to determine a current position difference, which represents a difference between an actual position and the nominal position at the measurement point in time; and controlling the position by at least one of the tools of the forming device, which tool or tools determines a pitch of the helical spring as a function of the position difference.

* * * * *